US011853011B2

(12) United States Patent
Lazzari

(10) Patent No.: US 11,853,011 B2
(45) Date of Patent: Dec. 26, 2023

(54) WATCH CASE PROVIDED WITH AN ANNULAR RING, AND A WRISTWATCH AND A WRISTWATCH ASSEMBLY KIT COMPRISING THE SAME

(71) Applicant: OMEGA SA, Biel/Bienne (CH)

(72) Inventor: Nicolas Lazzari, Bienne (CH)

(73) Assignee: OMEGA SA, Biel/Bienne (CH)

( * ) Notice: Subject to any disclaimer, the term of this patent is extended or adjusted under 35 U.S.C. 154(b) by 569 days.

(21) Appl. No.: 16/727,010

(22) Filed: Dec. 26, 2019

(65) Prior Publication Data

US 2020/0209807 A1 Jul. 2, 2020

(30) Foreign Application Priority Data

Dec. 27, 2018 (EP) ..... 18248099

(51) Int. Cl.
*G04B 37/14* (2006.01)
*A44C 5/14* (2006.01)

(52) U.S. Cl.
CPC ..... *G04B 37/1486* (2013.01); *A44C 5/147* (2013.01)

(58) Field of Classification Search
CPC ..... G04B 37/1486; A44C 5/147; Y10T 24/47
USPC ..... 368/281
See application file for complete search history.

(56) References Cited

U.S. PATENT DOCUMENTS 4,347,594 A * 8/1982 Tschanz ..... G04B 19/223 368/21
5,158,219 A 10/1992 Baumgartner et al.
5,647,518 A 7/1997 Baumgartner et al.
2006/0114752 A1* 6/2006 Saunier ..... G04B 37/1486 368/281

(Continued)

FOREIGN PATENT DOCUMENTS

CH 698 652 B1 9/2009
CH 702734 A2 * 8/2011 ..... A44C 5/14

(Continued)

OTHER PUBLICATIONS

Office Action dated Feb. 26, 2021 in corresponding Korean Patent Application No. 10-2019-0163855 (with English Translation), 10 pages.

(Continued)

*Primary Examiner* — Edwin A. Leon
*Assistant Examiner* — Kevin Andrew Johnston
(74) *Attorney, Agent, or Firm* — Oblon, McClelland, Maier & Neustadt, L.L.P.

(57) ABSTRACT

A watch case for a wristwatch including a case middle having a central axis, a case back, bracelet attachment device removably connected to the case middle, and an annular ring rotatably mounted about the central axis of the case middle, the annular ring being provided with mechanical locking device capable, when the annular ring is in a locking position, of cooperating with complementary engagement device arranged on the bracelet attachment device, in order to secure the attachment device to the case (Continued)

middle. The annular ring is held between the case middle and the case back and the mechanical locking device include at least one resilient member, the member being elastically engaged with the complementary engagement device when the annular ring is in the locking position.

20 Claims, 5 Drawing Sheets

(56) References Cited

U.S. PATENT DOCUMENTS

| | | | | |
|---|---|---|---|---|
| 2009/0022014 | A1* | 1/2009 | Gracia | G04B 37/0445 368/311 |
| 2014/0029394 | A1 | 1/2014 | Saunier | |
| 2018/0032033 | A1* | 2/2018 | Mollier | G04B 37/0463 |
| 2018/0032034 | A1* | 2/2018 | Vuille | G04B 47/04 |
| 2018/0307333 | A1* | 10/2018 | Lim | G04R 20/02 |

FOREIGN PATENT DOCUMENTS

| | | | | |
|---|---|---|---|---|
| EP | 0 461 069 | A1 | 12/1991 | |
| EP | 3 070 546 | B1 | 10/2017 | |
| EP | 3070546 | B1 * | 10/2017 | G04B 37/1486 |
| FR | 3 040 219 | A1 | 2/2017 | |
| WO | WO 2012/139663 | A1 | 10/2012 | |
| WO | WO-2017029544 | A1 * | 2/2017 | G04B 37/1493 |

OTHER PUBLICATIONS

Japanese Office Action dated Dec. 22, 2020 in Japanese Patent Application No. 2019-215207 (with English translation), 10 pages.
European Search Report dated Jul. 4, 2019 in European Application 18248099.6 filed on Dec. 27, 2018 (with English Translation of Categories of Cited Documents), 6 pages.

* cited by examiner

WATCH CASE PROVIDED WITH AN ANNULAR RING, AND A WRISTWATCH AND A WRISTWATCH ASSEMBLY KIT COMPRISING THE SAME

CROSS-REFERENCE TO RELATED APPLICATION

This application claims priority to European Patent Application No. 18248099.6 filed on Dec. 27, 2018, the entire disclosure of which is hereby incorporated herein by reference.

FIELD OF THE INVENTION

The invention concerns a watch case for a wristwatch.

The invention also concerns a wristwatch comprising the watch case and a two-part bracelet attached to the watch case.

The invention further concerns a wristwatch assembly kit comprising the wristwatch and one or more spare bracelets.

STATE OF THE ART

In the field of wristwatches, it is known to attach the bracelet to the watch case horns, by means of securing systems such as spring bars, metal slugs or screws. In all cases, it is not easy for the user of such a wristwatch to disassemble the bracelet from the watch, for example to change the bracelet. Indeed, this operation requires a suitable tool, but such a tool is sometimes only available to professionals in the field. Replacement of a bracelet must therefore, in most cases, be carried out by a professional, which consequently increases the duration and cost of the operation.

In order to overcome this drawback, there are also known wristwatches with interchangeable bracelets. Such a wristwatch is, for example, disclosed in European Patent No. EP 3070546B1. In this wristwatch, the watch case includes a case middle having a central axis, means for attaching a bracelet in the form of lugs removably connected to the case middle, and an annular ring forming the back cover of the watch case. The annular ring is rotatably mounted around the central axis of the case middle and includes mechanical locking means in the form of hooks. When the annular ring is rotated into a locking position, the hooks are capable of sliding into a channel provided in the attachment lugs in order to lock the lugs in position and thereby secure the bracelet to the watch case. This channel thus forms a means of engaging the hooks, which is complementary thereto.

However, one drawback of the watch case proposed in EP Patent No. 3070546B1 is that it introduces perceptible play or free motion between the bracelet and the case middle, particularly play in the direction parallel to the central axis of the case middle.

SUMMARY OF THE INVENTION

It is thus an object of the invention to provide a watch case for a wristwatch with interchangeable bracelets which reduces or removes potentially perceptible free motion or play between the bracelet and the case middle, and thus to improve the integration between these two elements.

The invention therefore concerns a watch case for a wristwatch, which includes the features mentioned in the independent claim 1.

Specific embodiments of the watch are defined in the dependent claims 2 to 17.

One advantage of the watch case according to the invention lies in the fact that the mechanical locking means comprise at least one resilient member. The resilient member is resiliently engaged with the complementary engagement means when the annular ring is in its locking position. Owing to the inherent resilience of the resilient member, any potential free motion or play between the bracelet and the case middle is advantageously made up. This improves the integration of the watch case/bracelet assembly by offering no visible play between the two elements. Further, the wristwatch user can quickly and easily secure or release the bracelet to or from the case middle in a single rotational action on the annular ring of the watch case. When the annular ring is in its unlocking position, the complementary engagement means provided on the bracelet attachment means are released, thereby releasing the attachment means from the case middle and thus removing the bracelet from the case middle.

Advantageously, the annular ring has a constant cross-section and includes at least one recess capable of cooperating with the complementary engagement means provided on the bracelet attachment means, the complementary engagement means forming said or one of said resilient member(s) and taking the form of a strip spring provided on the bracelet attachment means.

Advantageously, the annular ring includes at least one thinned portion configured to allow elastic deformation, along a radius, of the annular ring in a plane in which it extends, the or each thinned portion having at least one recess capable of cooperating with the complementary engagement means provided on the bracelet attachment means, said recess forming said or one of said resilient member(s). This saves space in the width of the system, since the annular ring works by bending in its plane. Further, this configuration does not require any parts to be placed on the annular ring in order to ensure mechanical locking of the assembly, since the annular ring is formed from a single piece of material. Such an arrangement is also compact in diameter, which makes it possible to obtain optimal integration between the bracelet and the case middle.

Advantageously, the case middle is provided with two pairs of opposite horns, the horns of a same pair being arranged facing each other, and the bracelet attachment means comprise a pair of bars and a pair of end pieces, each bar being secured between the horns of one of said pairs of horns, each end piece being capable of being joined to an end portion of the bracelet, having a U-shaped cross section and being removably mounted on one of the bars. This makes it easier to secure and release the bracelet to and from the case middle, in a single action of the user, and to allow precise positioning of the bracelet by sliding each end piece onto one of the bars.

Advantageously, each end piece is provided with a groove for receiving the mechanical locking means of the annular ring, said groove extending over an external face of the end piece in contact with the case middle. This forces the end piece to rotate around the bar to completely make up any potentially perceptible play. This feature also provides a mechanical stop in the direction parallel to the central axis of the case middle.

Advantageously, the watch case includes at least one stop for the annular ring. This prevents the annular ring rotating too far around the central axis of the case middle.

To this end, the invention also concerns a wristwatch comprising the watch case described above, which includes the features mentioned in the dependent claim 16.

To this end, the invention also concerns a wristwatch assembly kit, comprising the wristwatch described above, and which includes the features mentioned in the dependent claim 17.

BRIEF DESCRIPTION OF THE DRAWINGS

The objects, advantages and features of the watch case and of the wristwatch and of the assembly kit comprising the same will appear more clearly in the following description based on at least one non-limiting embodiment, illustrated by the drawings, in which.

DETAILED DESCRIPTION OF THE INVENTION

Figure 1:
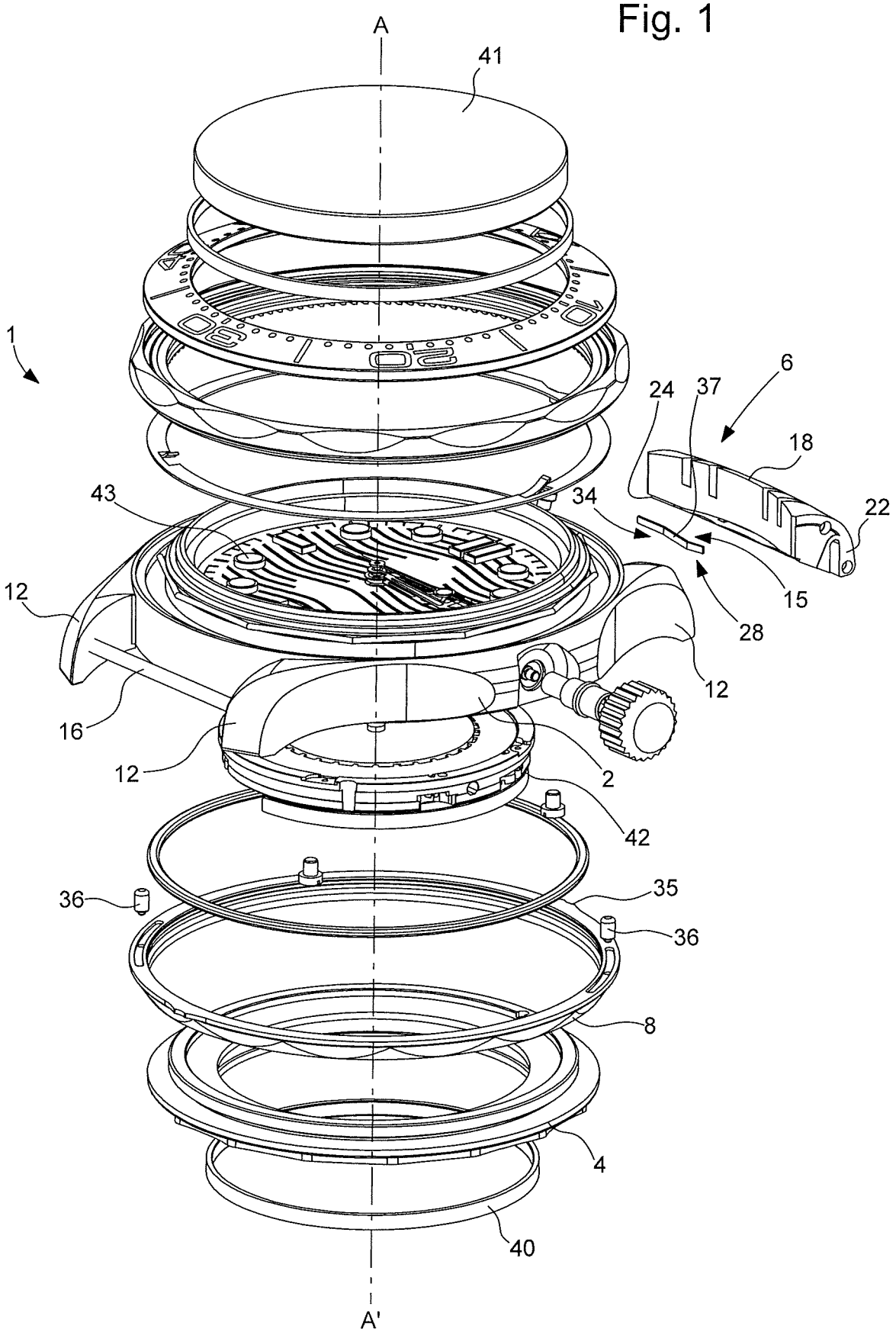
FIG. 1 is an exploded view of a watch case for a wristwatch according to a first embodiment.

FIG. 1 represents a watch case 1 for a wristwatch. A bracelet or strap in two parts (not represented) is removably attached to watch case 1. The wristwatch may, for example, be part of a kit (not represented) which also includes one or more additional bracelets. Such additional bracelets form as many interchangeable bracelets for the wristwatch, which can be removably attached to watch case 1. By way of non-limiting example, the interchangeable bracelets may, for example, be made of metal, plastic, or a flexible material such as leather.

In the following description, in a non-limiting manner, elements will be referred to as 'internal' or 'external' according to the orientation thereof with respect to watch case 1.

As illustrated in FIGS. 1 to 6*c*, watch case 1 includes a case middle 2, a back cover 4, bracelet attachment means 6 and an annular ring 8. Preferably, watch case 1 further includes at least one stop for annular ring 8. This stop is not represented in the Figures for reasons of clarity. According to an example embodiment, each stop is a pin. Each stop is, for example, arranged on case middle 2 or on case back 4 and is configured to cooperate with a slot provided in annular ring 8. Preferably, each stop is shaped to prevent rotation of annular ring 8 over a predetermined angular range.

Figure 2:
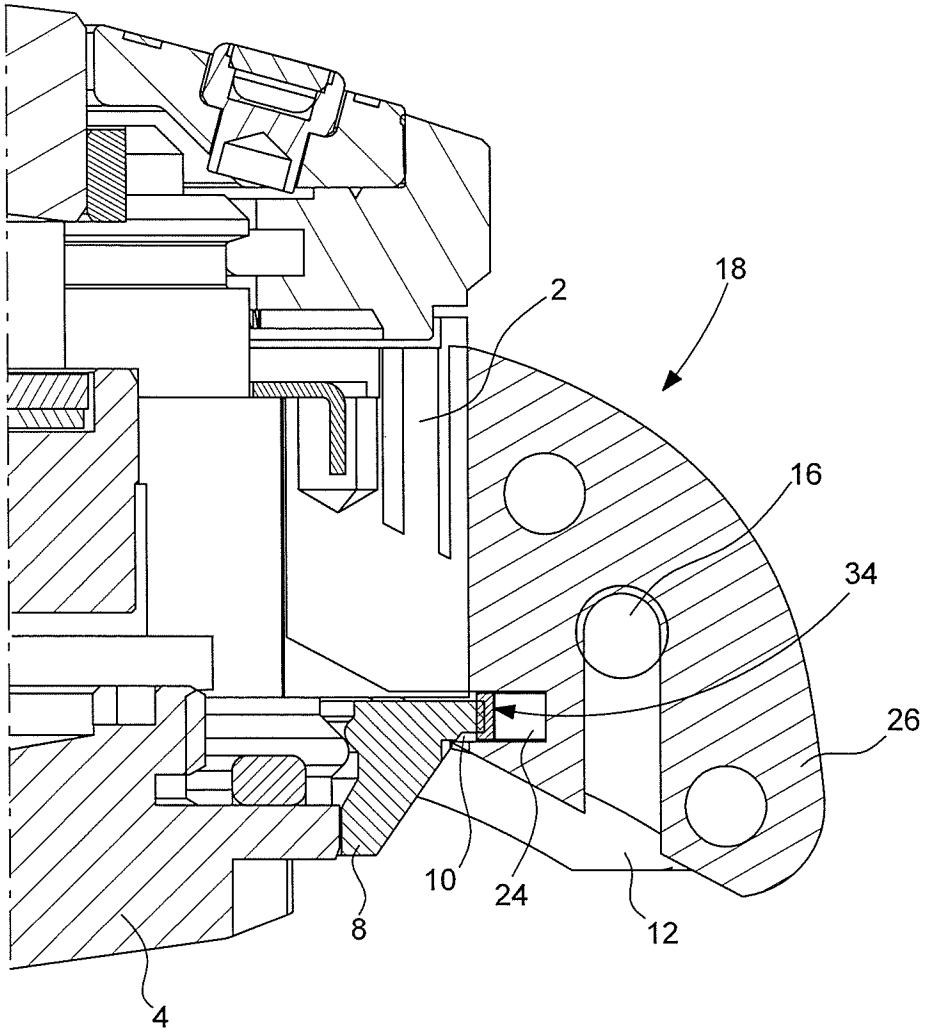
FIG. 2 is a sectional view of one part of the watch case of FIG. 1.

Case middle 2 has a central axis A-A' and is placed on case back 4. As illustrated in FIG. 2, case middle 2 and case back 4 together define a space 10 for receiving annular ring 8, this space 10 being open on the side. Annular ring 8 is thus held between case middle 2 and case back 4, inside space 10.

In the circular watch case 1 taken as an example in FIGS. 1 to 6*c*, case middle 2 and case back 4 are annular in shape, and space 10 takes the form of a slot for receiving annular ring 8. However, the invention is not limited to such a circular configuration of watch case 1, or to the other arrangements described above for case middle 2 and for case back 4. Depending on the design and geometry of case middle 2, watch case 1 can be of variable shape to ensure good handling and functionality of the assembly.

In the illustrative example embodiment of FIGS. 1 to 3*c*, case middle 2 is provided with two pairs of opposite horns 12. The two pairs of horns 12 are arranged at around 180 degrees from each other, on either side of case middle 2. Each horn 12 is oriented in a longitudinal direction generally corresponding to the direction of extension of the bracelet. The longitudinal direction substantially corresponds to the 6 o'clock-12 o'clock direction of watch case 1 when the bracelet is attached to watch case 1. Each horn 12 includes a housing 14 for receiving a slug of a bar, as will be described below. The horns 12 of a same pair of horns are arranged facing each other, to allow a securing bar to be attached thereto.

Case back 4 is, for example, closed by a back crystal 40, and watch case 1 is closed on the upper part thereof by a crystal 41, said case receiving at least one movement 42 surmounted by a dial 43.

Figure 3A:
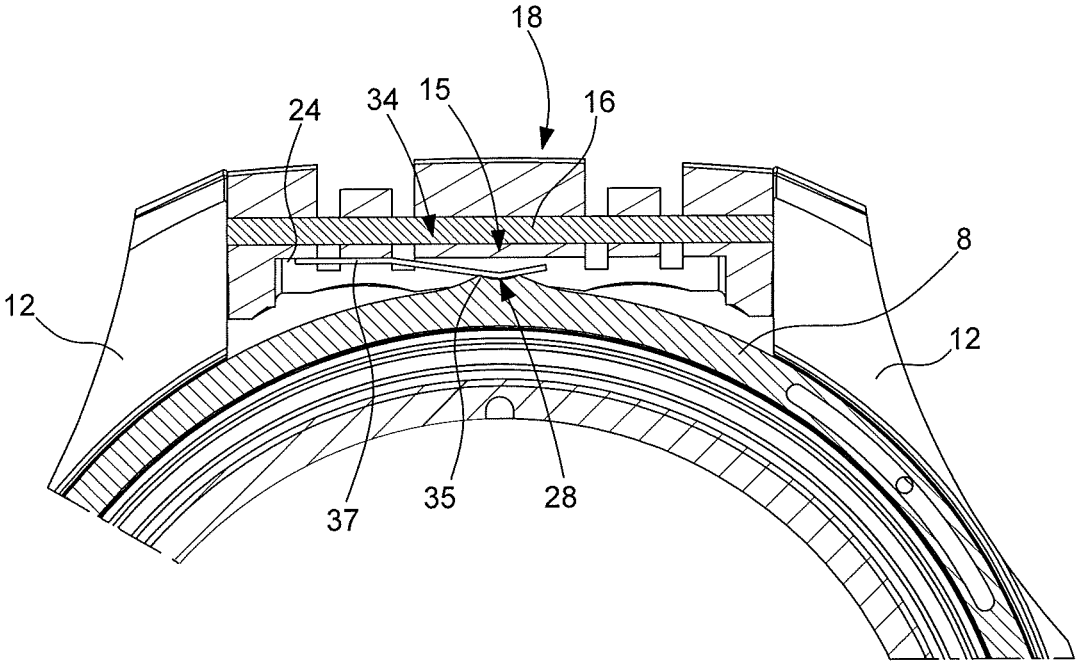
FIGS. 3*a* and 3*b* are sectional views of the watch case of FIG. 1, respectively in a locking position of the annular ring, and in an unlocking position of the annular ring.
Figure 3B:
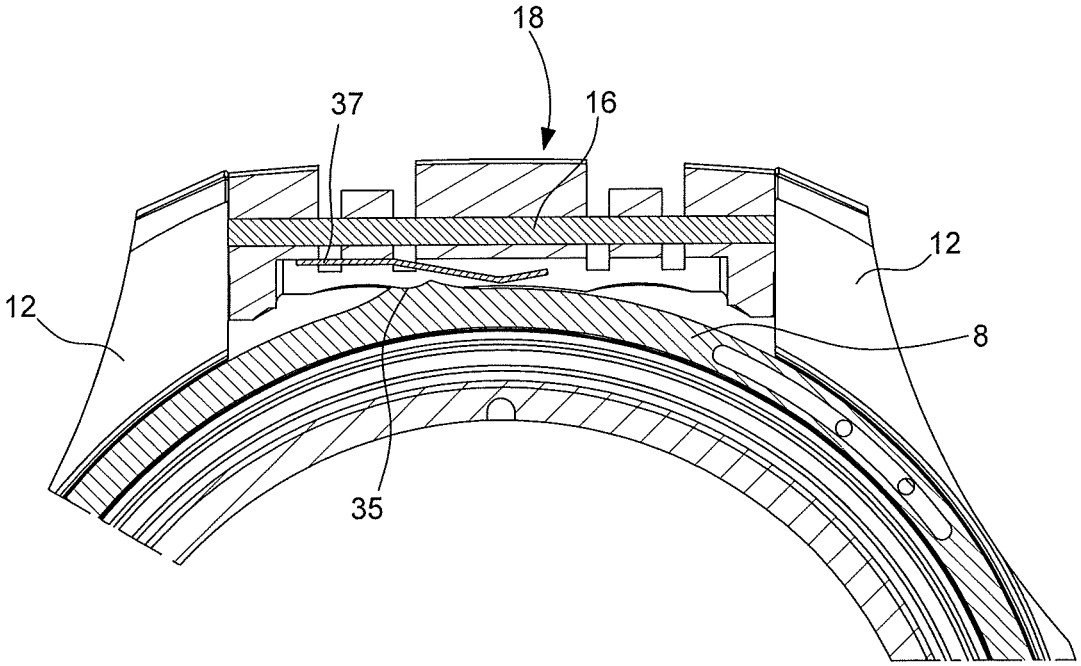
Figure 4:
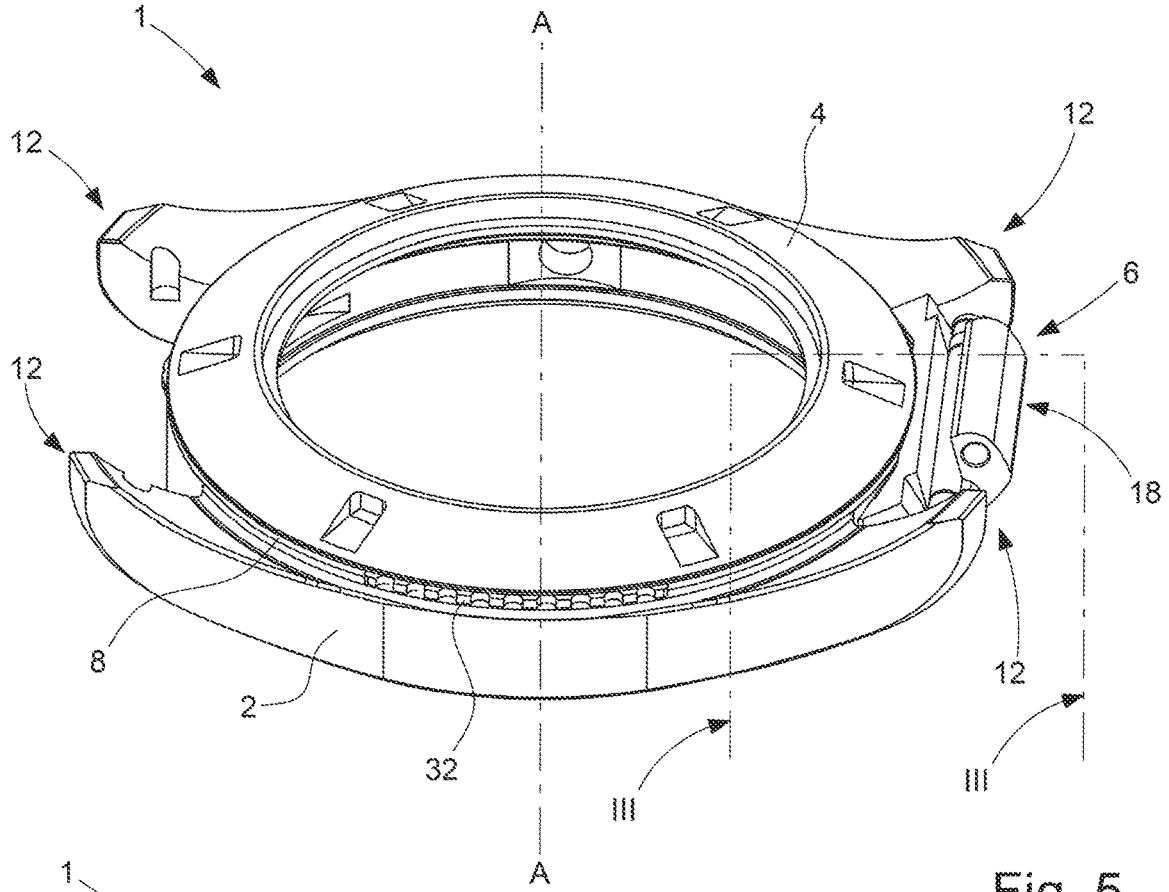
FIG. 4 is a perspective bottom view of a watch case for a wristwatch according to the invention, the watch case comprising an annular ring.
Figure 5:
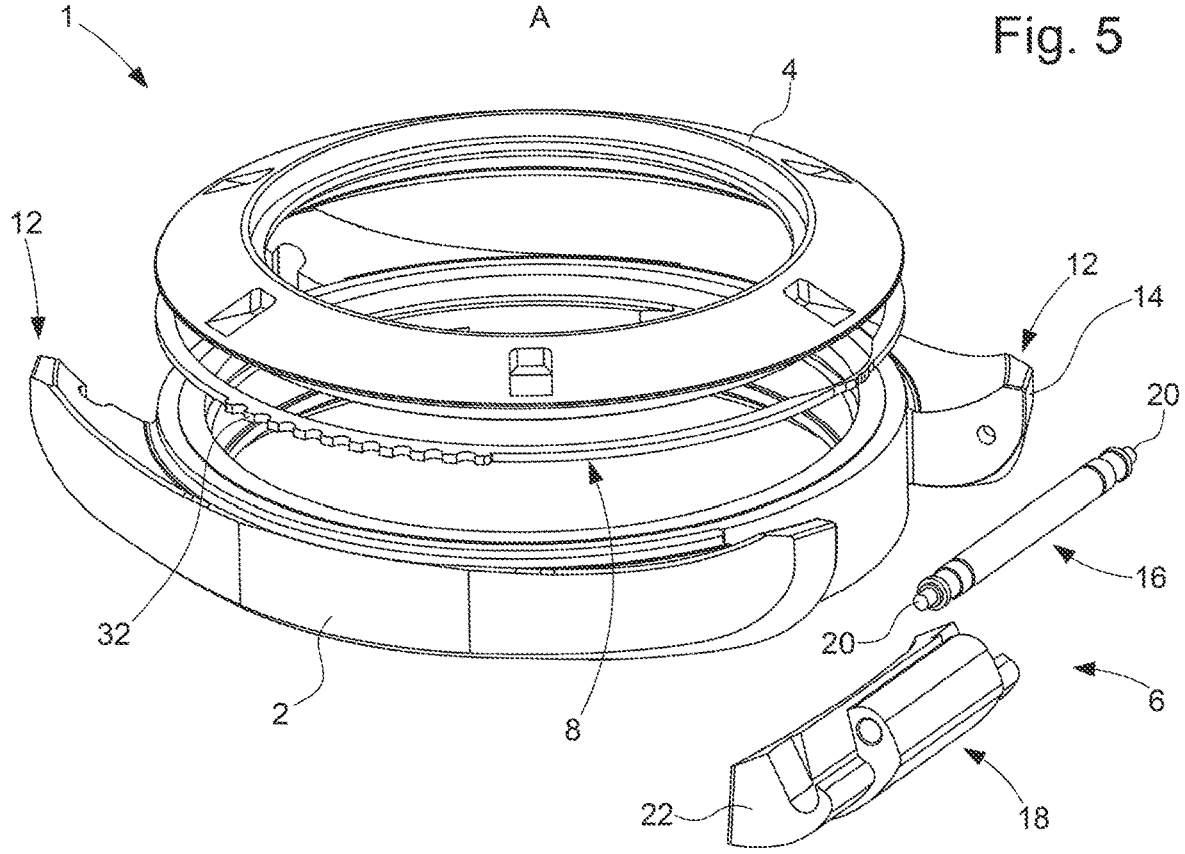
FIG. 5 is an exploded perspective view of the watch case of FIG. 4.

As illustrated in FIGS. 3*a* and 3*b* and as will be detailed below, bracelet attachment means 6 include engagement means 15 capable of cooperating in a complementary manner with mechanical locking means. Attachment means 6 are removably connected to case middle 2. More precisely, in the illustrative example of FIGS. 1 to 3, attachment means 6 comprise a pair of bars 16 and a pair of end pieces 18.

Each bar 16 is secured between the horns 12 of a same pair of horns 12. To this end, each bar 16 includes, for example, two slugs 20 at the ends thereof. Each slug 20 of a bar 16 is received in a corresponding housing 14 of a horn 12.

As seen, for example, in FIGS. 1, 3*a*, 4 and 6*b*, each end piece 18 has a substantially U-shaped cross-section and is removably mounted on one of bars 16. Each end piece 18 is mounted on a bar 16 from the top of the latter. Each bar 16 on which an end piece 18 is mounted extends inside the 'U' formed by end piece 18. When mounted on a corresponding bar 16, the largest dimension of each end piece 18 extends in a direction substantially parallel to the direction of extension of bar 16. Each end piece 18 is also attached to an end portion of the bracelet, although this attachment is not shown in the Figures since it does not form the subject of the present invention.

In the example embodiment illustrated in FIG. 2, each end piece 18 is provided, on one of its external faces 22, with a groove 24. This external face 22 of end piece 18 is in contact with case middle 2 when end piece 18 is mounted on a corresponding bar 16. Groove 24, which extends over the entire length of end piece 18 (the length being taken as the largest dimension in which end piece 18 extends) is configured to receive mechanical locking means, as will be described below.

Figure 6A:
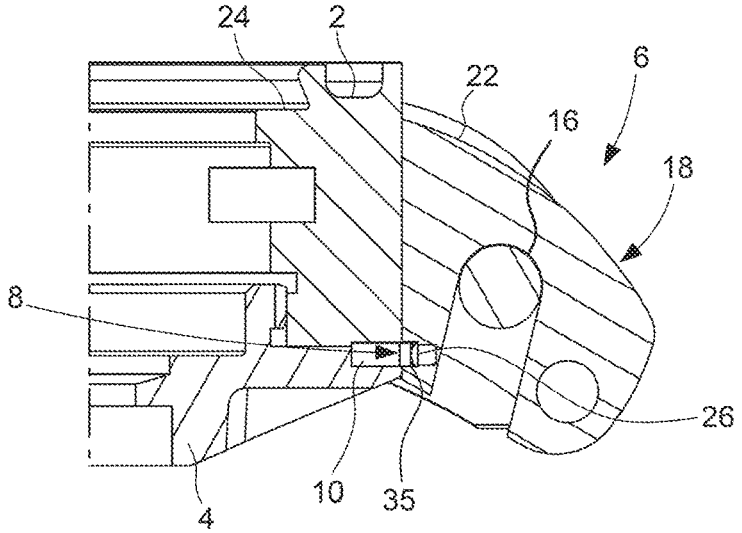
FIG. 6*a* is a sectional view of one part of the watch case of FIG. 4, along a sectional plane III-III and upside down compared to the FIG. 4 view.
Figure 6B:
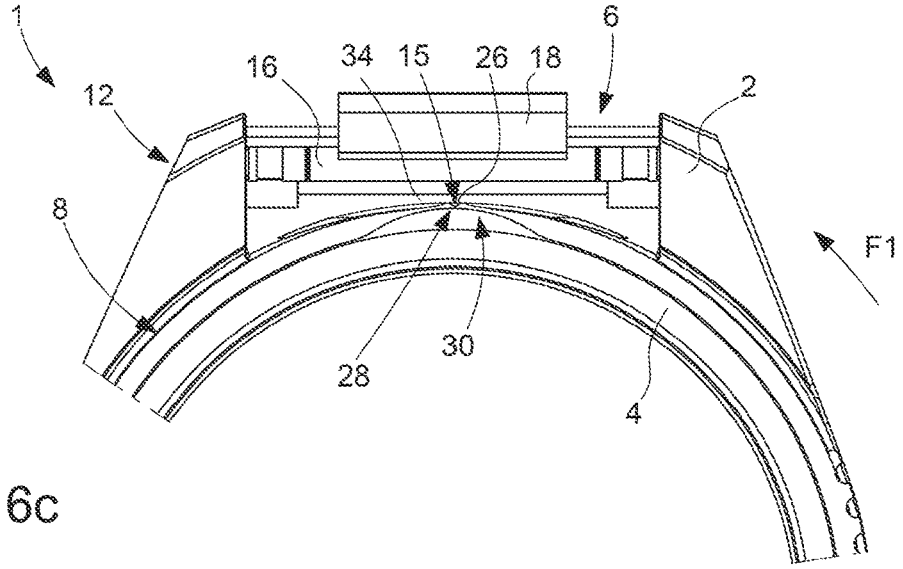
FIG. 6*b* is a bottom view of the watch case of FIG. 4 in a locking position of the annular ring.
Figure 6C:
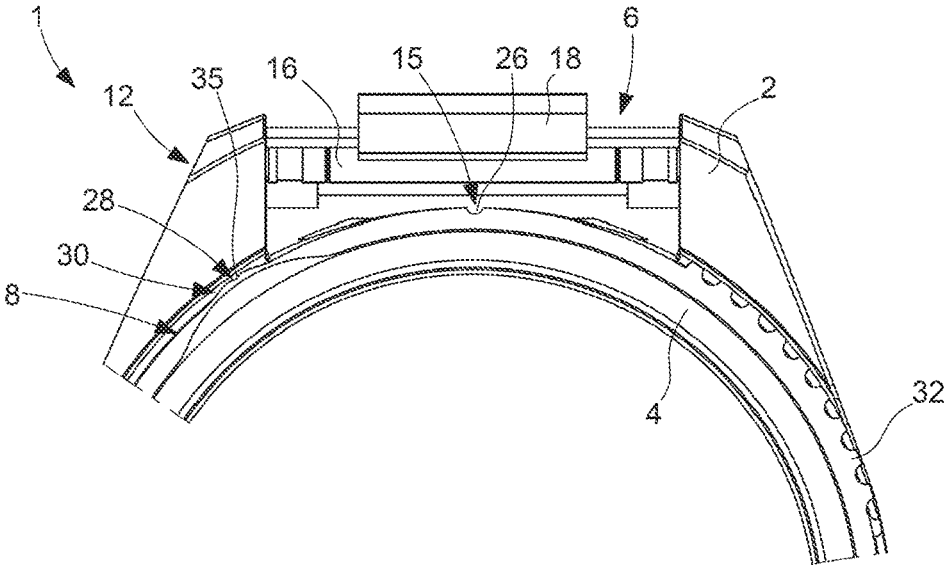
FIG. 6*c* is a similar view to that of FIG. 4, in an unlocking position of the annular ring.

According to an example embodiment illustrated in FIGS. 6*b* and 6*c*, groove 24 of each end piece 18 is provided with a lug 26 which protrudes from the bottom of groove 24. Lug 26 is, for example, arranged in a median part of groove 24. According to this example embodiment, lug 26 forms engagement means 15. According to a variant that is not represented in the Figures, groove 24 is shaped such that the reception of the mechanical locking means inside the groove locks said means inside the groove. In this variant, the groove forms engagement means 15.

Annular ring 8 is rotatably mounted around central axis A-A' of case middle 2. Annular ring 8 includes mechanical locking means 28 which, when ring 8 is in a locking position, can cooperate with complementary engagement means 15 in order to secure attachment means 6 to case middle 2. Thus, annular ring 8 is rotatable about axis A-A' between a locking position in which attachment means 6, and thus the bracelet, are secured to case middle 2, and an unlocking position in which attachment means 6, and thus the bracelet, are detached from case middle 2. These two locking and unlocking positions, which will be detailed below, are respectively illustrated in FIGS. 3*a*, 3*b*, 6*b* and 6*c*.

According to a first embodiment, illustrated in FIGS. 1 to 3*b*, annular ring 8 has a constant cross-section and includes at least one recess 35 at the periphery thereof, recess 35 being arranged to cooperate with a strip spring 37 arranged in end piece 18 and configured to allow elastic deformation. Strip spring 37 has a free end which is shaped to lodge inside recess 35 when these two parts are opposite each other and thus to lock end piece 18. According to the illustrated example, annular ring 8 includes two recesses 35, arranged at 180 degrees from each other on the ring.

Mechanical locking means 28 include at least one resilient member 34, capable of resiliently engaging with complementary engagement means 15 when annular ring 8 is in its locking position. In the example embodiment illustrated in FIGS. 1 to 3*b*, mechanical locking means 28 comprise two resilient members 34, arranged at 180 degrees from each other on end piece 18. According to this example embodiment, ring 8 has two recesses 35 arranged to cooperate with one resilient member 34. As seen in FIGS. 3*a* and 3*b*, owing to the flexibility provided by the corresponding strip spring 37, each recess 35 is capable of cooperating with complementary engagement means 15, more specifically with a bent portion of resilient strip 37, in order to mechanically lock annular ring 8 and to secure attachment means 6 to case middle 2. To this end and as illustrated in FIG. 3*a*, in the locking position of ring 8, each portion of ring 8 bearing a recess 35 protrudes beyond the external periphery of case middle 2 and is accommodated in groove 24 of one of end pieces 18.

According to a second embodiment illustrated in FIGS. 4 to 6*c*, annular ring 8 further includes at least one thinned portion 30 configured to allow elastic deformation, on a radius, of the annular ring in the plane in which it extends. In example embodiment illustrated in FIGS. 4 to 6*c*, annular ring 8 comprises two thinned portions 30 arranged at 180 degrees from each other. Thinned portions 30 are arranged to give annular ring 8 flexibility in the plane in which it extends. Preferably, annular ring 8 also includes, on the external periphery thereof, an actuation portion 32. Such an actuation portion 32 extends outside watch case 1, on one side of the case, and is configured to allow a user of the wristwatch to push ring 8 in rotation, in order to move ring 8 between its locking and unlocking positions and vice versa. Annular ring 8 is, for example, made of metal but could be made of any other material, for example plastic material.

Mechanical locking means 28 include at least one resilient member 34, capable of elastically engaging with complementary engagement means 15 when annular ring 8 is in its locking position. In the example embodiment illustrated in FIGS. 4 to 6*c*, mechanical locking means 28 comprise two resilient members 34, arranged at 180 degrees from each other on ring 8. According to this example embodiment, each thinned portion 30 has one recess 35, which forms one of the resilient members. As seen in FIGS. 6*b* and 6*c*, owing to the flexibility provided by the corresponding thinned portion 30, each recess 35 is capable of cooperating with complementary engagement means 15, more specifically with one of lugs 26, in order to mechanically lock annular ring 8 and to secure attachment means 6 to case middle 2. To this end and as illustrated in FIG. 6*b*, in the locking position of ring 8, each portion of ring 8 bearing a recess 35 protrudes beyond the external periphery of case middle 2 and is accommodated in groove 24 of one of end pieces 18.

Preferably, as illustrated in FIGS. 6*b* and 6*c*, each thinned portion 30 is thinned radially. Each recess 35 is, for example, arranged in a median part of one of thinned portions 30.

In a variant that is not represented in the Figures, each resilient member 34 is a ball catch. Such a ball catch is, for example, placed in end piece 18, and annular ring 8 is provided with a housing to cooperate with the ball catch, such a housing forming complementary engagement means 15.

The operation of watch case 1 according to the second embodiment of the invention will now be described with reference to FIGS. 6*b* and 6*c*.

As illustrated in FIG. 6*c*, when annular ring 8 is in its locking position, locking means 28 cooperate with complementary engagement means 15 in order to secure attachment means 6 and thus the bracelet to case middle 2. More specifically, in the illustrative example of FIG. 4, each recess 35 provided on annular ring 8 cooperates elastically with a lug 26 provided on one of end pieces 18. When the user wishes to change from the locking position to the unlocking position, he rotates annular ring 8 in the direction of arrow F1, for example by pushing or pulling actuation portion 32. The system can evidently operate clockwise and anticlockwise for the locking and/or unlocking function.

As illustrated in FIG. 6*c*, when annular ring 8 is in its unlocking position, complementary engagement means 15 are released, which releases attachment means 6 from case middle 2, and thus releases the bracelet from case middle 2. In the illustrative example of FIG. 5, the two end pieces 18 are released at the same time, owing to the rotation of annular ring 8 to its unlocking position.

It is thus understood that the user can quickly and easily secure or release the bracelet to or from case middle 2 and release the two end pieces 18 at the same time in a single action on annular ring 8.

The operation of watch case 1 according to the first embodiment of the invention is evidently similar, the user need only move the annular ring to lock or unlock the end piece.

The invention claimed is:

1. A watch case for a wristwatch comprising a case middle having a central axis, a case back, bracelet attachment means removably connected to the case middle, and an annular ring rotatably mounted about the central axis of the case middle, the annular ring being provided with mechanical locking means capable, when the annular ring is in a locking position, of cooperating with complementary engagement means provided on the bracelet attachment means, in order to secure the bracelet attachment means to the case middle;

wherein the annular ring is held between the case middle and the case back and has an outer peripheral surface with a first portion exposed between the case middle and the case back and a second portion comprising the mechanical locking means, and wherein the complementary engagement means comprise at least one resilient member, said member being elastically engaged with the mechanical locking means when the annular ring is in the locking position and locking the annular ring in the locking position.

2. The watch case according to claim 1, wherein the annular ring has a constant cross-section and comprises at least one recess capable of cooperating with the complementary engagement means provided on the bracelet attachment means, the complementary engagement means forming said at least one resilient member.

3. The watch case according to claim 1, wherein said at least one resilient member is a strip spring integral with the bracelet attachment means.

4. The watch case according to claim 1, wherein the annular ring comprises at least one thinned portion configured to allow elastic deformation, on a radius, of the annular ring in a plane in which the annular ring extends, each thinned portion having at least one recess capable of cooperating with the complementary engagement means provided on the bracelet attachment means.

5. The watch case according to claim 4, wherein said thinned portion is thinned radially.

6. The watch case according to claim 4, wherein said recess is arranged in a median part of the thinned portion.

7. The watch case according to claim 1, wherein the case middle is provided with two pairs of opposite horns, the horns of a same pair being arranged facing each other, and the bracelet attachment means comprise a pair of bars and a pair of end pieces, each bar being secured between the horns of one of said pairs of horns, each end piece being capable of being joined to an end part of the bracelet, having a U-shaped cross-section and being removably mounted on one of the bars.

8. The watch case according to claim 7, wherein each end piece is provided with a groove for receiving the mechanical locking means of the annular ring, said groove extending over an external face of the end piece in contact with the case middle.

9. The watch case according to claim 8, wherein the groove is shaped such that the reception of the mechanical locking means inside the groove locks said mechanical locking means inside the groove, the groove forming said complementary engagement means.

10. The watch case according to claim 8, wherein the groove includes a lug protruding from the bottom of the groove, said lug forming said complementary engagement means and being capable of cooperating with a recess on the annular ring in order to mechanically lock the annular ring and to secure the bracelet attachment means to the case middle.

11. The watch case according to claim 1, wherein each resilient member is a ball catch.

12. The watch case according to claim 1, wherein the watch case comprises at least one stop for the annular ring.

13. The watch case according to claim 12, wherein said at least one stop is arranged on the annular ring and is capable of cooperating with a slot provided in the case middle.

14. The watch case according to claim 12, wherein said at least one stop is a pin.

15. The watch case according to claim 12, wherein said at least one stop is shaped to prevent rotation of the annular ring over a predetermined angular range.

16. A wristwatch comprising a watch case according to claim 1 and a two-part bracelet attached to the watch case, wherein each part of the bracelet is secured to the bracelet attachment means of the watch case.

17. A wristwatch assembly kit comprising a wristwatch according to claim 16 and one or more spare bracelets, each spare bracelet being in two parts, each part each spare bracelet being configured to attach to the bracelet attachment means of the watch case.

18. The watch case according to claim 1, wherein the annular ring includes an inner circumferential surface located inward of an outer circumferential surface;

the mechanical locking means are provided on the outer circumferential surface of the annular ring;

the complementary engagement means are provided on the bracelet attachment means outside of the outer circumferential surface; and the at least one resilient member is configured to engage with the outer circumferential surface.

19. The watch case according to claim 18, wherein said at least one resilient member is a strip spring integral with the bracelet attachment means and having a bent portion configured to engage with the locking means.

20. The watch case according to claim 18, wherein the complementary engagement means comprises a lug protruding from a groove in the bracelet attachment means, the lug being retractable into the groove, and the lug engaging with the outer circumferential surface.

* * * * *